US010049631B2

(12) United States Patent
Aoki et al.

(10) Patent No.: US 10,049,631 B2
(45) Date of Patent: Aug. 14, 2018

(54) NON-RECTANGULAR DISPLAY DEVICE WITH SIGNAL LINES AND BUS LINES

(71) Applicant: Japan Display Inc., Minato-ku (JP)

(72) Inventors: Yoshiro Aoki, Tokyo (JP); Hiroyuki Kimura, Tokyo (JP); Shinichiro Oka, Tokyo (JP)

(73) Assignee: Japan Display Inc., Minato-ku (JP)

( * ) Notice: Subject to any disclaimer, the term of this patent is extended or adjusted under 35 U.S.C. 154(b) by 94 days.

(21) Appl. No.: 15/018,967

(22) Filed: Feb. 9, 2016

(65) Prior Publication Data

US 2016/0240157 A1 Aug. 18, 2016

(30) Foreign Application Priority Data

Feb. 12, 2015 (JP) ..... 2015-025540

(51) Int. Cl.
*G09G 3/36* (2006.01)

(52) U.S. Cl.
CPC ..... *G09G 3/3648* (2013.01); *G09G 3/3666* (2013.01); *G09G 2300/0426* (2013.01); *G09G 2300/08* (2013.01); *G09G 2310/0218* (2013.01); *G09G 2310/0281* (2013.01); *G09G 2310/08* (2013.01)

(58) Field of Classification Search
CPC ..... G09G 2300/0426; G09G 2300/08; G09G 2310/0218; G09G 2310/0281; G09G 2310/08; G09G 3/3648; G09G 3/3666
See application file for complete search history.

(56) References Cited

U.S. PATENT DOCUMENTS 8,139,194 B2 * 3/2012 Yamamoto ..... G02F 1/13454 345/55
2009/0102758 A1 4/2009 Anzai et al.
2011/0285950 A1 * 11/2011 Su ..... G02F 1/136286 349/139

FOREIGN PATENT DOCUMENTS

JP 2008-216894 9/2008
JP 5191286 5/2013

* cited by examiner

*Primary Examiner* — Ram Mistry
(74) *Attorney, Agent, or Firm* — Oblon, McClelland, Maier & Neustadt, L.L.P.

(57) ABSTRACT

According to one embodiment, an active matrix display device includes a non-rectangular display portion in which a part of an outer edge is curved or bent, display pixels arrayed in a matrix in the display portion, gate lines connected for each row of the display pixels, signal lines connected for each column of the display pixels, a gate line driving circuit, a signal line driving circuit, and bus lines extending along a part of an edge of the display portion outside the display portion. A part of the signal lines extends from an edge opposite to the bus lines of the display portion to the bus lines through the display portion, is connected to the bus lines, and further, extends from the bus lines to the edge opposite to the bus lines through the display portion.

15 Claims, 4 Drawing Sheets

NON-RECTANGULAR DISPLAY DEVICE WITH SIGNAL LINES AND BUS LINES

CROSS-REFERENCE TO RELATED APPLICATIONS

This application is based upon and claims the benefit of priority from Japanese Patent Application No. 2015-025540, filed Feb. 12, 2015, the entire contents of which are incorporated herein by reference.

FIELD

Embodiments described herein relate generally to an active matrix display device.

BACKGROUND

Recently, the use of mobile devices such as smartphones and tablet terminals has spread rapidly. The size and resolution of the displays used in these mobile devices have been dramatically increased, so that the ratio of the area of the display screen to that of the mobile device has steadily increased. As a result, the shape of the display device itself has become an important factor in determining the shape of the mobile device.

However, the display is rectangular in most cases because, for example, the embedded driving circuits or various lines in the active matrix can be easily arranged in a rectangle. Accordingly, the outline of the mobile device is substantially rectangular.

This tendency is clearer with the increasing ratio of the display area to the total area of the mobile device. As a result, mobile devices are forced to employ very similar designs for their housings.

To resolve this situation, a display device in which the display portion has a different shape such as circular or elliptical is considered. However, in this case, it is difficult to compactly allocate the driving circuits for driving the display region and a large number of lines extending from a COG mounting portion such that they do not interfere with each other. In this manner, the size or area of the frame region other than the display region is increased. As a result, the proportion of the display region or the display screen to the mobile device is reduced.

DETAILED DESCRIPTION

Figure 1:
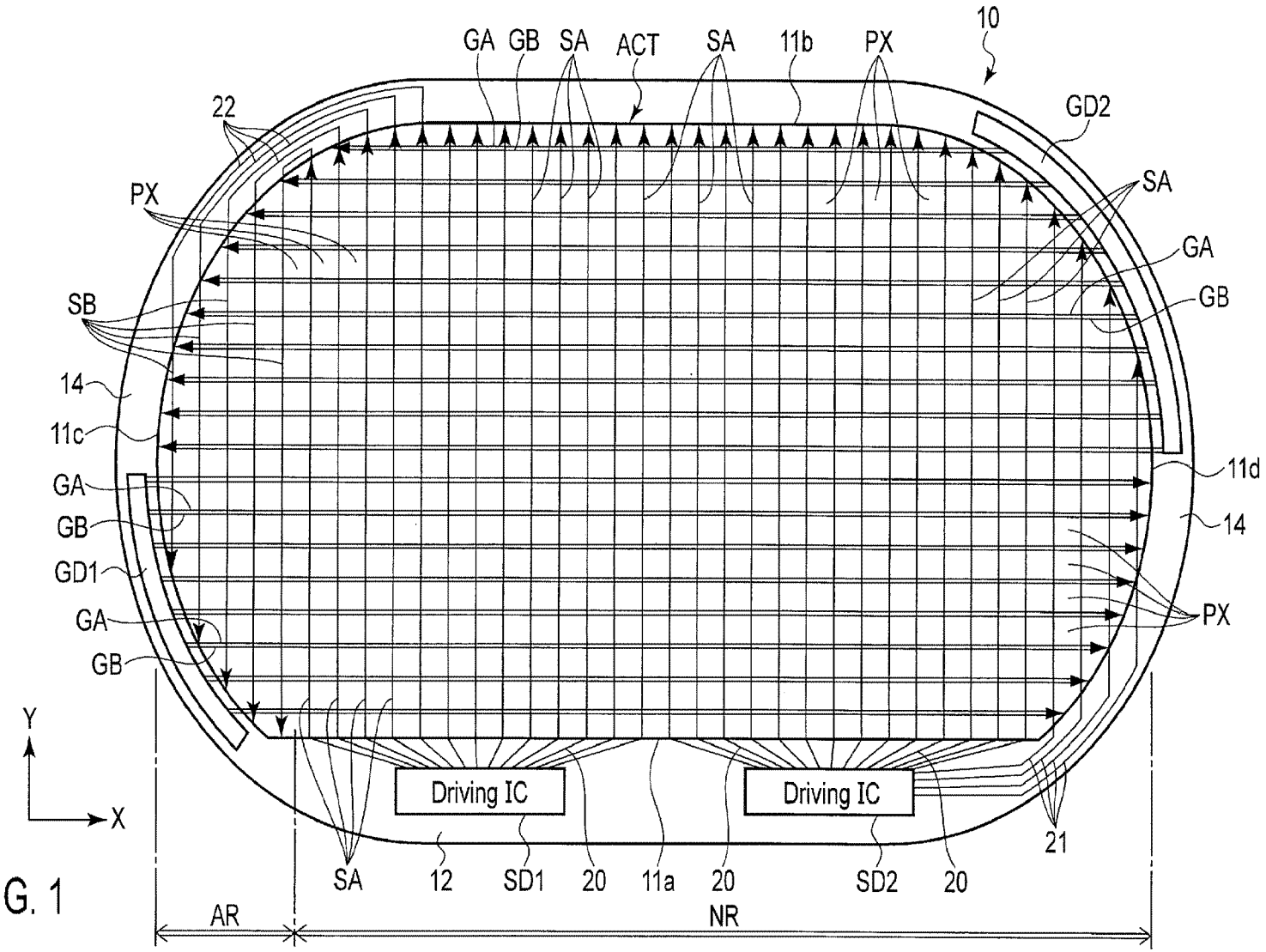
FIG. 1 is a plan view schematically showing a structural example of a display device according to a first embodiment.

Various embodiments will be described hereinafter with reference to the accompanying drawings. In general, according to one embodiment, an active matrix display device comprises a non-rectangular display portion in which at least a part of an outer edge is curved or bent; a plurality of display pixels arrayed in a matrix in the display portion; a plurality of gate lines connected for each row of the display pixels; a plurality of signal lines connected for each column of the display pixels; a gate line driving circuit configured to drive the gate lines; a signal line driving circuit configured to supply a video signal to the signal lines; and a plurality of bus lines extending along a part of an edge of the display portion outside the display portion. At least a part of the signal lines connected to the signal line driving circuit extends from an edge opposite to the bus lines of the display portion to the bus lines through the display portion, is connected to the bus lines, and further, extends from the bus lines to the edge opposite to the bus lines through the display portion.

The disclosure is merely an example, and proper changes within the spirit of the invention, which are easily conceivable by a skilled person, are included in the scope of the invention as a matter of course. In addition, in some cases, in order to make the description clearer, the widths, thicknesses, shapes, etc. of the respective parts are schematically illustrated in the drawings, compared to the actual modes. However, the schematic illustration is merely an example, and adds no restrictions to the interpretation of the invention. Besides, in the specification and drawings, the same elements as those described in connection with preceding drawings are denoted by like reference numerals, and a detailed description thereof is omitted unless otherwise necessary.

First Embodiment

FIG. 1 is a plan view schematically showing a structural example of an active matrix display device according to a first embodiment. Here, a liquid crystal display device is explained as an example of a display device comprising an array substrate. A liquid crystal display device 10 can be used when it is incorporated into various electronic devices such as a smartphone, a tablet terminal, a mobile phone, a notebook computer, a portable games console, an electronic dictionary or a television device.

As shown in FIG. 1, the liquid crystal display device 10 comprises an insulating substrate 12 having a light transmitting property such as a glass substrate, a display portion (a display area or an active area) ACT which is provided on the insulating substrate 12 and displays an image, and driving circuits GD1, GD2, SD1 and SD2 which drive the display portion ACT. The display portion ACT comprises a number of display pixels PX arrayed in a matrix. The driving circuits GD1, GD2, SD1 and SD2 are connected to a controller (not shown) provided outside the display portion ACT.

The display portion ACT is formed in a non-rectangular shape such that at least a part of the outer edge includes a curved line or a line of flexure, for example, in an elliptical shape, an oval shape or a circular shape. In the present embodiment, the display portion ACT is formed in an oval shape comprising linear edges 11*a* and 11*b* facing each other, and arc-shaped edges 11*c* and 11*d* facing each other on the left and right. The insulating substrate 12 is formed in an oval shape which is substantially similar to the display portion ACT and is larger than the display portion ACT. Thus, the insulating substrate 12 comprises an annular frame region 14 located in the outer circumference of the display portion ACT.

The display portion ACT comprises an arc-shaped region (a second region) AR defined by one of the arc-shaped edges, for example, the left arc-shaped edge 11*c*, and the remaining normal display region (specifically, the central rectangular region and an arc-shaped region defined by the right arc-shaped edge 11*d*) (a first region) NR.

The pair of signal line driving circuits SD1 and SD2 is formed in the frame region 14 of the insulating substrate 12, and is adjacent to and faces the linear edge 11*a* of the display portion ACT. The pair of gate line driving circuits GD1 and GD2 is formed in the frame region 14 of the insulating substrate 12. One gate line driving circuit GD1 is adjacent to and faces the lower half of the left arc-shaped edge 11*c*, and is shaped like an arc along the arc-shaped edge 11*c*. The other gate line driving circuit GD2 is adjacent to and faces the upper half of the right arc-shaped edge 11*d*, and is shaped like an arc along the arc-shaped edge 11*d*. Thus, the pair of gate line driving circuits GD1 and GD2 is provided separately in two positions which face each other in the direction (in a diagonal direction) of opposing corners of the display portion ACT.

A plurality of first gate lines GA (GA1 to GAn) each extending in a first direction X (a horizontal direction), a plurality of second gate lines GB (GB1 to GBn) each extending in the first direction X, a plurality of first signal lines SA each extending in a second direction Y orthogonal to the first direction X and a plurality of second signal lines SB each extending in the second direction Y are formed in the display portion ACT. In addition, a capacitance line, a power supply line, etc., (not shown) are provided in the display portion ACT.

Two gate lines which are the first gate line GA and the second gate line GB are provided for the display pixels PX of each row. The first and second gate lines GA and GB located in the lower half portion of the display portion ACT extend from one gate line driving circuit GD1 to the right arc-shaped edge 11*d* through the display portion ACT. The first and second gate lines GA and GB located in the upper half portion of the display portion ACT extend from the other gate line driving circuit GD2 to the left arc-shaped edge 11*c* through the display portion ACT.

In the normal display region NR of the display portion ACT, the plurality of first signal lines SA are provided and extend along the display pixels PX of columns. In the arc-shaped region AR, the plurality of second signal lines SB are provided and extend along the display pixels PX of columns.

The plurality of first signal lines SA provided in the central rectangular region of the normal display region NR are connected to the signal line driving circuits SD1 and SD2 through respective linear lines 20, and extend from the lower linear edge 11*a* to the upper linear edge 11*b*. The plurality of first signal lines SA provided in the arc-shaped region defined by the right arc-shaped edge 11*d* in the normal display region NR are connected to the signal line driving circuit SD2 through diagonal or arc-shaped lines 21. The arc-shaped lines 21 are formed in positions facing the lower half of the right arc-shaped edge 11*d* in the frame region 14. The group of arc-shaped lines 21 is provided in a position which does not interfere with the gate line driving circuit GD2 or the signal line driving circuit SD2. The first signal lines SA extend from the lower half to the upper half of the arc-shaped edge 11*d*.

In the frame region 14, a plurality of bus lines 22 are formed in positions facing the upper half of the left arc-shaped edge 11*c* and extend in an arc-like shape along the arc-shaped edge 11*c*. The bus lines 22 are provided in positions which do not interfere with the gate line driving circuit GD1 or the signal driving circuit SD1. The bus lines 22 are provided so as to face the arc-shaped lines 21 in the direction of opposing corners of the display portion ACT.

The plurality of first signal lines SA provided in the area adjacent to the arc-shaped region AR in the normal display region NR extend beyond the upper linear edge 11*b* and are connected to ends of the bus lines 22. The other ends of the bus lines 22 are connected to the second signal lines SB. The plurality of second signal lines SB extend from the bus lines 22 to the lower half of the arc-shaped edge 11*c* through the arc-shaped region AR.

Thus, the plurality of second signal lines SB are electrically connected to the first signal lines SA through the bus lines 22. The first signal lines SA, the bus lines 22 and the second signal lines SB may be structured integrally by common signal lines. The plurality of signal lines pass the display portion ACT, go out to the frame region 14, and subsequently, turn back and extend in the display portion ACT again.

Figure 2:
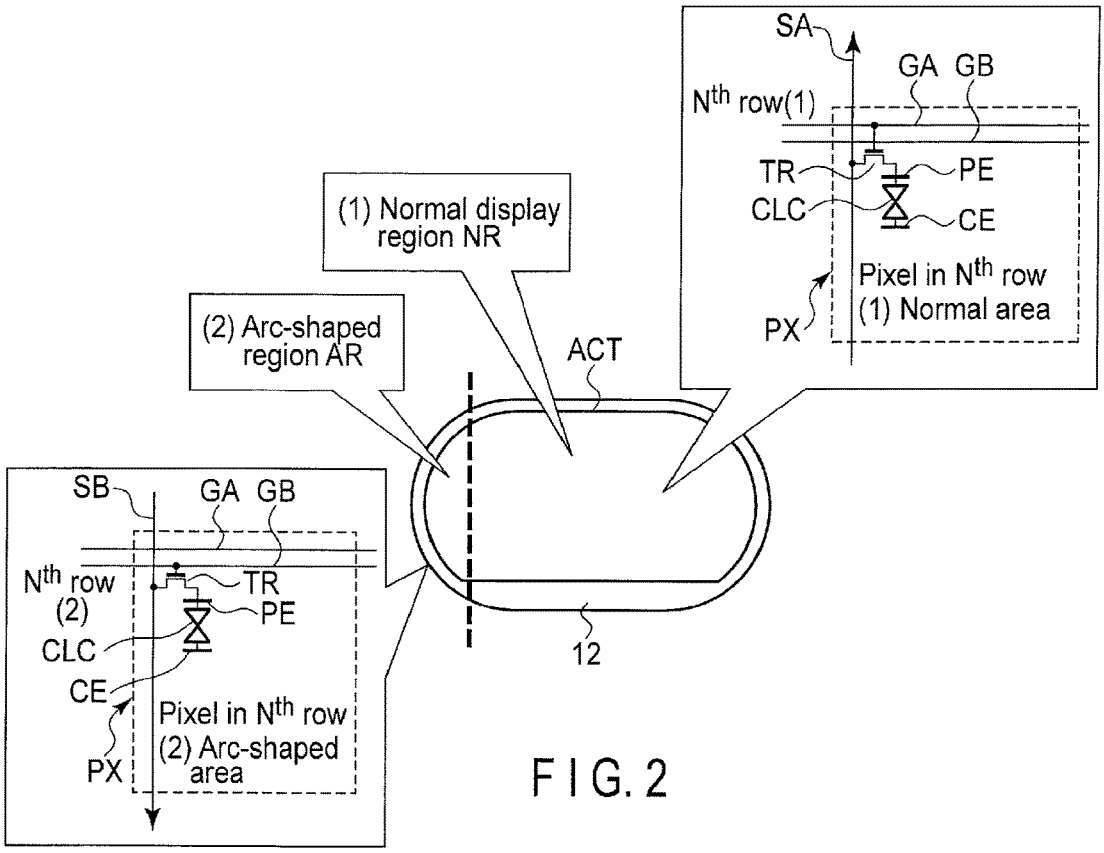
FIG. 2 is a plan view schematically showing enlarged views of pixel portions of the display device shown in FIG. 1.

FIG. 2 schematically shows enlarged views of display pixels PX. Each of the display pixels PX located in the normal display region NR comprises, for example, liquid crystal capacitance CLC, a thin-film transistor (TFT) TR, and storage capacitance (not shown) in parallel with the liquid crystal capacitance CLC. The liquid crystal capacitance CLC comprises a pixel electrode PE connected to the thin-film transistor TR, a common electrode CE electrically connected to the supply portion of a common potential, and a liquid crystal layer interposed between the pixel electrode PE and the common electrode CE. The thin-film transistor TR is electrically connected to the first gate line GA and the first signal line SA.

A control signal for controlling turning on and off the thin-film transistor TR is supplied from the gate line driving circuits GD1 and GD2 to the first gate line GA. A video signal is supplied from the signal line driving circuits SD1 and SD2 to the first signal line SA. The thin-film transistor TR writes a pixel potential to the pixel electrode PE in accordance with the video signal supplied to the first signal line SA when the thin-film transistor TR is turned on based on the control signal supplied to the first gate line GA. The voltage applied to the liquid crystal layer is controlled by the difference in potential between the common electrode CE of the common potential and the pixel electrode PE of the pixel potential.

As shown in FIG. 2, each of the display pixels PX located in the arc-shaped region AR comprises, for example, liquid crystal capacitance CLC, a thin-film transistor (TFT) TR and storage capacitance (not shown) in parallel with the liquid crystal capacitance CLC. The liquid crystal capacitance CLC comprises a pixel electrode PE connected to the thin-film transistor TR, a common electrode CE electrically connected to the supply portion of a common potential, and a liquid crystal layer interposed between the pixel electrode PE and the common electrode CE. The thin-film transistor TR is electrically connected to the second gate line GB and the second signal line SB.

A control signal for controlling turning on and off the thin-film transistor TR is supplied from the gate line driving circuits GD1 and GD2 to the second gate line GB. A video signal is supplied from the signal line driving circuit SD1 to the second signal line SB through the first signal line SA and the bus line 22. The thin-film transistor TR writes a pixel potential to the pixel electrode PE in accordance with the video signal supplied to the second signal line SB when the thin-film transistor TR is turned on based on the control signal supplied to the second gate line GB. The voltage applied to the liquid crystal layer is controlled by the difference in potential between the common electrode CE of the common potential and the pixel electrode PE of the pixel potential.

Figure 3:
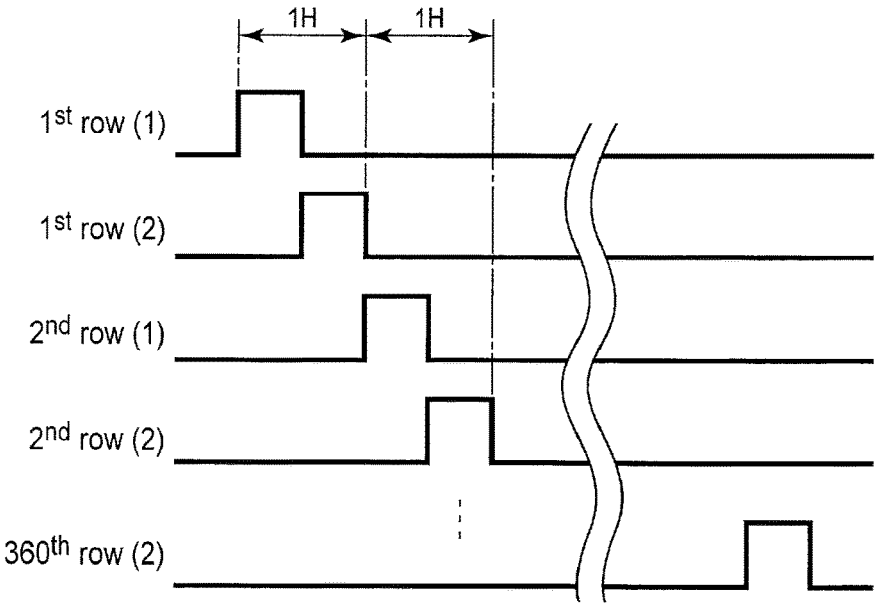
FIG. 3 is a timing chart showing a gate signal of the display device.

In the liquid crystal display device 10 having the above structure, a horizontal period H is divided into two parts. In the first half, video signals are written to the display pixels PX of the normal display region NR. In the latter half, video signals are written to the display pixels PX of the arc-shaped region AR. As shown in FIG. 3, the gate line driving circuits GD1 and GD2 output an on-signal to the first gate line GA in the first half of a horizontal period 1H and output an on-signal to the second gate line GB in the latter half of the horizontal period 1H.

In a manner similar to that of a normal display device, the signal line driving circuits SD1 and SD2 drive the first signal lines SA and the second signal lines SB in series and output a video signal in accordance with the timing at which the first and second gate lines GA and GB are turned on.

According to the liquid crystal display device 10 having the above structure, a part of the signal lines is configured to pass the display portion ACT, and subsequently, turn back through the bus lines 22 provided along the edge opposite to the line input portion and enter the arc-shaped region AR of the display portion ACT again. This structure enables the gate line driving circuits GD1, GD2 and the signal line driving circuits SD1, SD2 to be located in positions which do not interfere with the group of bus lines 22. For example, the gate line driving circuits GD1 and GD2 are dispersed in positions which do not interfere with the group of bus lines 22 or the group of arc-shaped lines 21. In this manner, interference between the group of lines and the driving circuits is eliminated. This structure realizes the display portion ACT having a different shape or a non-rectangular shape such as an elliptical shape or an oval shape, and the display device 10 without expanding the frame region 14 of the display device 10.

The shape of the display portion ACT or the insulating substrate 12 is not limited to the above oval shape and may be various non-rectangular shapes such as an elliptical shape, an elongated circular shape, a circular shape, a semi-elliptical shape, a gourd-like shape or any shape in which at least a part of the edge is curved or bent. In the first embodiment, the positions of the group of bus lines and the gate line driving circuit GD1 may be replaced by the positions of the gate line driving circuit GD2 and the group of arc-shaped lines between the left side and the right side. The number of signal lines turning back from the first signal lines to the second signal lines may be increased or decreased in accordance with the shape, size, etc., of the arc-shaped region.

Now, this specification explains a display device according to another embodiment. In the embodiment explained below, the portions identical with those of the first embodiment are denoted by the same reference numbers or symbols. Thus, the detailed description of the same portions is omitted. Mainly, portions different from those of the first embodiment are explained in detail below.

Second Embodiment

Figure 4:
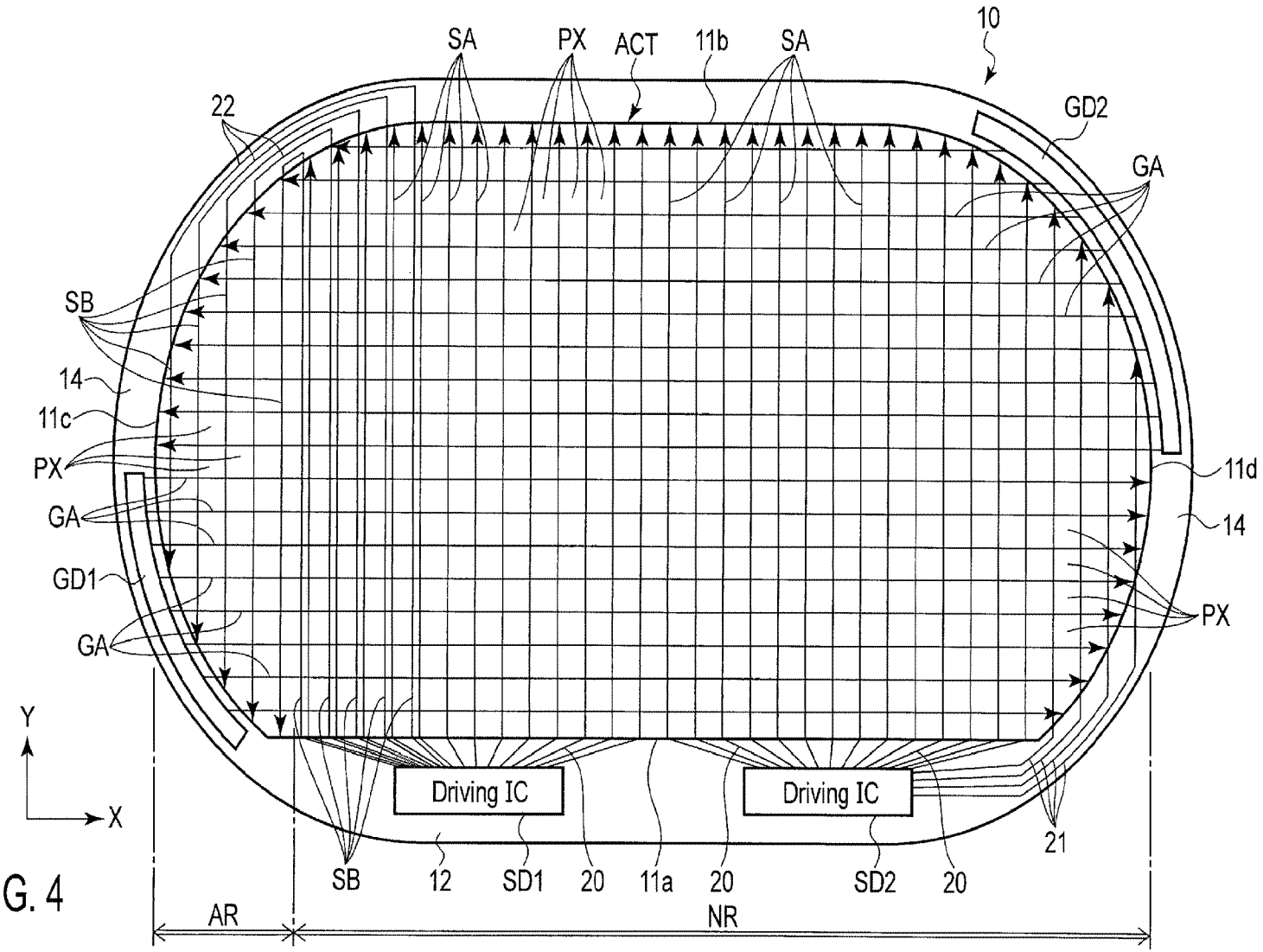
FIG. 4 is a plan view schematically showing a structural example of a display device according to a second embodiment.

FIG. 4 is a plan view schematically showing a structural example of an active matrix display device according to a second embodiment. In the second embodiment, only one gate line (a first gate line GA) is provided for the display pixels PX of each row. A plurality of second signal lines SB extend parallel to first signal lines SA in a normal display region NR of a display portion ACT, and subsequently, turn back through bus lines 22, enter an arc-shaped region AR through the bus lines 22 and extend to the lower end of the arc-shaped region AR. The input terminal of each second signal line SB is connected to a signal line driving circuit SD1 through a line 20. The number of second signal lines SB is appropriately adjusted in accordance with the size of the arc-shaped region AR.

Gate line driving circuits GD1 and GD2 are provided in positions which do not interfere with the group of bus lines 22 and a group of arc-shaped lines 21, respectively. Similarly, the signal line driving circuits SD1 and SD2 are provided in positions which do not interfere with the group of bus lines 22, the group of arc-shaped lines 21 and the gate line driving circuits GD1 and GD2.

Figure 5:
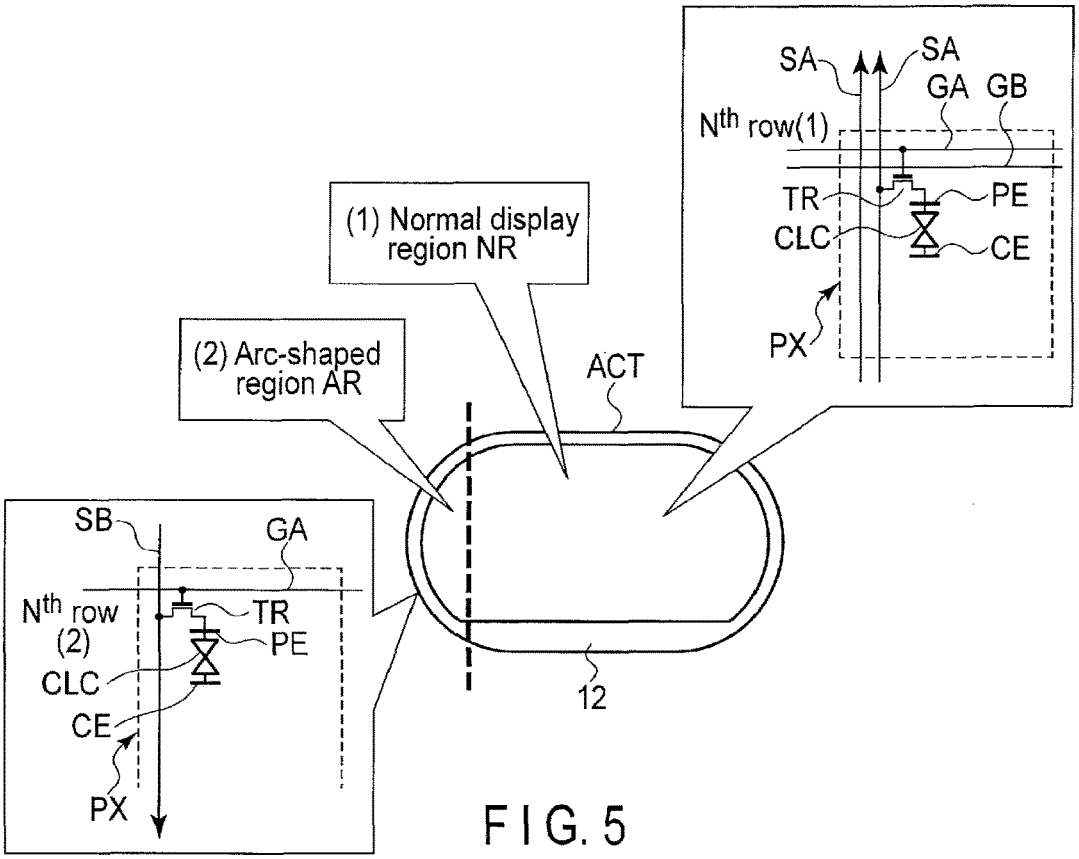
FIG. 5 is a plan view schematically showing enlarged views of pixel portions of the display device shown in FIG. 4.

FIG. 5 schematically shows enlarged views of display pixels PX. In the plurality of display pixels PX located in the normal display region NR, a thin-film transistor (TFT) TR is electrically connected to the first gate line GA and the first signal line SA. In the plurality of display pixels PX located in the arc-shaped region AR, the thin-film transistor TR is electrically connected to the first gate line GA and the second signal line SB.

The other structures of the display device 10 are the same as those of the display device of the first embodiment.

Figure 6:
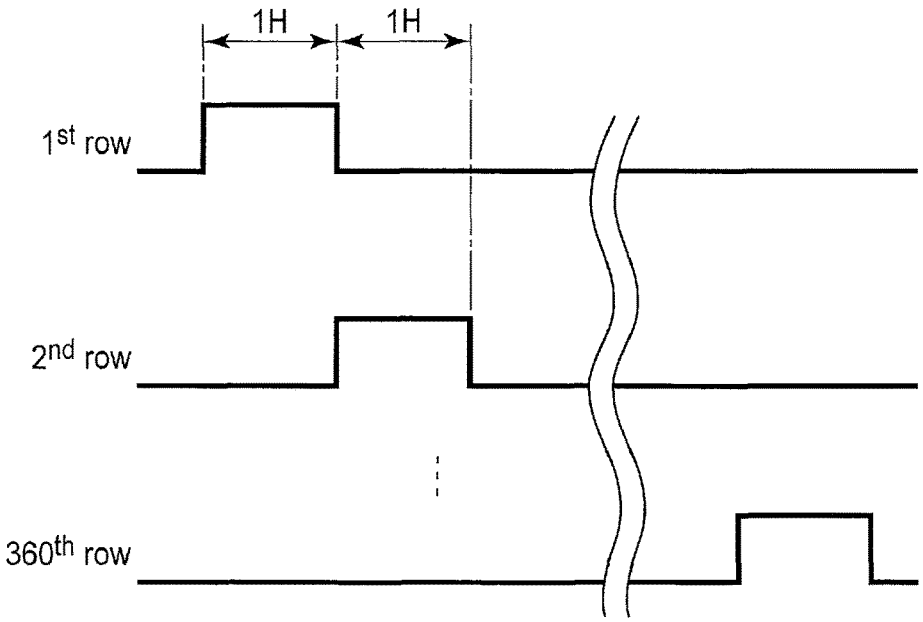
FIG. 6 is a timing chart showing a gate signal of the display device according to the second embodiment.

In the liquid crystal display device 10 of the second embodiment, it is possible to deal with the timing chart, the number of gate lines, etc., with a structure equivalent to that of the conventional technique. For example, as shown in FIG. 6, the gate line driving circuits GD1 and GD2 are capable of outputting an on-signal in series to the first gate line GA in each horizontal period H and writing video signals to the display pixels PX of the normal display region NR and the display pixels PX of the arc-shaped region AR in each horizontal period.

According to the liquid crystal display device 10 of the second embodiment having the above structure, the plurality of second signal lines are configured to pass the display portion ACT, and subsequently, turn back through the bus lines 22 provided along the edge opposite to the line input portion and enter the arc-shaped region AR of the display portion ACT again. This structure enables the gate line driving circuits and the signal line driving circuits to be located in positions which do not interfere with the group of bus lines. In this manner, interference between the group of lines and the driving circuits is eliminated. This structure realizes the display portion having a different shape or a non-rectangular shape such as an elliptical shape or an oval shape, and the display device 10 without expanding a frame region 14 of the display device 10. According to the second embodiment, the display device can be driven with a driving signal at a driving timing in a manner similar to that of a normal display device.

In a manner similar to that of the first embodiment, in the above second embodiment, the shape of the display portion ACT or the insulating substrate is not limited to the above oval shape and may be various non-rectangular shapes such as an elliptical shape, a circular shape or any shape in which at least a part of the edge is curved or bent. In the second embodiment, the positions of the group of bus lines and the gate line driving circuit GD1 may be replaced by the positions of the gate line driving circuit GD2 and the group of arc-shaped lines between the left side and the right side. The number of second signal lines turning back in the positions of the bus lines may be increased or decreased in accordance with the shape, size, etc., of the arc-shaped region.

In the above embodiments, a liquid crystal display device is shown as a disclosure example of a display device. As other application examples, various types of flat-panel display devices can be considered. For example, an organic electroluminescent (EL) display device, other auto-luminous light-emitting display devices and an electronic paper display device comprising an electrophoretic element may be considered. It goes without saying that a structure similar to that of the above-described embodiments can be applied to small, medium-sized and large display devices without particular limitation.

In the above explanation, the signal line driving circuits are formed in the frame region of the insulating substrate. However, the structure of the signal line driving circuits is not limited to this example. The signal line driving circuits may be provided outside the insulating substrate. In this case, the signal line driving circuits are electrically connected to a plurality of signal lines through a flexible printed circuit board or lines.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

All of the structures and manufacturing processes which can be implemented by a person of ordinary skill in the art through arbitrary design changes based on the structures and manufacturing processes described above as the embodiments of the present invention are included in the scope of the present invention as long as they encompass the spirit of the present invention. In addition, other effects which can be obtained by the above embodiments and are self-explanatory from the description of this specification or can be arbitrarily conceived by a person of ordinary skill in the art are considered to be achieved by the present invention as a matter of course.

What is claimed is:

1. An active matrix display device, comprising:

a display portion that is non-rectangular and in which at least a part of an outer edge is curved or bent;

a plurality of display pixels arrayed in a matrix in the display portion;

a plurality of gate lines connected for each row of the display pixels;

a plurality of signal lines connected for each column of the display pixels;

a gate line driving circuit configured to drive the gate lines;

a signal line driving circuit configured to supply a video signal to the signal lines; and a plurality of bus lines extending along a part of an edge of the display portion outside the display portion, wherein at least a part of the signal lines connected to the signal line driving circuit extends from an edge opposite to the bus lines of the display portion to the bus lines through the display portion, is connected to the bus lines, and extends from the bus lines to the edge opposite to the bus lines through the display portion to be open-ended, and the signal lines connected to the bus lines are arranged in a first region of the display portion and the signal lines not connected to the bus lines are arranged in a second region of the display portion, the second region being separated from the first region.

2. The active matrix display device of claim 1, wherein the plurality of signal lines include a plurality of first signal lines each having an end connected to the signal line driving circuit and the other end connected to an end of the respective bus lines, and a plurality of second signal lines each having an end connected to the other end of the respective bus lines, the second signal lines extending from the bus lines to the edge opposite to the bus lines through the display portion to be open-ended.

3. The active matrix display device of claim 2, wherein the plurality of gate lines include a plurality of first gate lines extending along display pixels of each row and supplying a control signal to the display pixels connected to the first signal lines, and a plurality of second gate lines extending along the display pixels of each row and supplying a control signal to the display pixels connected to the second signal lines.

4. The active matrix display device of claim 2, wherein the gate line driving circuit is provided in an area which is shifted from the bus lines outside the display portion.

5. The active matrix display device of claim 1, wherein the plurality of signal lines include a plurality of first signal lines each having an end connected to the signal line driving circuit and extending to an edge opposite to the signal line driving circuit through the display portion, and a plurality of second signal lines each having an end connected to the signal line driving circuit, extending to the bus lines parallel to the first signal lines, and subsequently, extending from the bus lines to the edge opposite to the bus lines through the display portion to be open-ended.

6. The active matrix display device of claim 5, wherein the gate line driving circuit is provided in which is shifted from the bus lines outside the display portion.

7. The active matrix display device of claim 1, wherein the gate line driving circuit is provided in an area which is shifted from the bus lines outside the display portion.

8. The active matrix display device of claim 1, wherein the display portion comprises a first edge which is curved, and the bus lines are provided along a part of the first edge.

9. The active matrix display device of claim 8, wherein the gate line driving circuit is provided along a portion different from the part of the first edge.

10. The active matrix display device of claim 9, wherein the display portion comprises an arc-shaped region defined by the first edge, and a normal display region continuous with the arc-shaped region, the plurality of signal lines include a plurality of first signal lines provided in the normal display region and connected to the signal line driving circuit, and a plurality of second signal lines provided in the arc-shaped region and connected to the bus lines, and the first signal lines located near the arc-shaped region are connected to the bus lines.

11. The active matrix display device of claim 9, wherein the display portion comprises an arc-shaped region defined by the first edge, and a normal display region continuous with the arc-shaped region, and the plurality of signal lines include a plurality of first signal lines provided in the normal display region and connected to the signal line driving circuit, and a plurality of second signal lines each having an end connected to the signal line driving circuit, extending to the bus lines through the normal display region and subsequently extending from the bus lines to the edge opposite to the bus lines through the arc-shaped region.

12. The active matrix display device of claim 8, wherein the display portion comprises an arc-shaped region defined by the first edge, and a normal display region continuous with the arc-shaped region, the plurality of signal lines include a plurality of first signal lines provided in the normal display region and connected to the signal line driving circuit, and a plurality of second signal lines provided in the arc-shaped region and connected to the bus lines, and the first signal lines located near the arc-shaped region are connected to the bus lines.

13. The active matrix display device of claim 8, wherein the display portion comprises an arc-shaped region defined by the first edge, and a normal display region continuous with the arc-shaped region, and the plurality of signal lines include a plurality of first signal lines provided in the normal display region and connected to the signal line driving circuit, and a plurality of second signal lines each having an end connected to the signal line driving circuit, extending to the bus lines through the normal display region and subsequently extending from the bus lines to the edge opposite to the bus lines through the arc-shaped region.

14. The active matrix display device of claim 1, wherein the display portion has an elliptical shape, an oval shape, an elongated circular shape or a circular shape.

15. The active matrix display device of claim 1, wherein a display area of the display portion is in a first plane, and the display portion is non-rectangular in the first plane.

* * * * *